US005718306A

United States Patent [19]

Baker

[11] Patent Number: 5,718,306

[45] Date of Patent: Feb. 17, 1998

[54] LADDER LEVELING DEVICE

[76] Inventor: Gerald Baker, 2526 Valley View, Missoula, Mont. 59803

[21] Appl. No.: 581,042

[22] Filed: Dec. 29, 1995

[51] Int. Cl.[6] ..... E06C 7/00

[52] U.S. Cl. ..... 182/204; 182/111

[58] Field of Search ..... 182/200–205; 182/111; 248/188.5

[56] References Cited

U.S. PATENT DOCUMENTS

| | | | |
|---|---|---|---|
| 979,821 | 12/1910 | Brasington | 182/205 |
| 987,960 | 3/1911 | Connors | 182/205 |
| 1,229,218 | 6/1917 | Bryant | 182/205 |
| 1,442,694 | 1/1923 | Martin . | |
| 2,177,677 | 10/1939 | Staben . | |
| 2,205,869 | 6/1940 | Wakeman . | |
| 2,371,460 | 3/1945 | Needham . | |
| 2,620,115 | 12/1952 | Guldjerd . | |
| 3,406,785 | 10/1968 | Pilcher | 182/205 |
| 3,948,352 | 4/1976 | Larson et al. . | |
| 4,669,576 | 6/1987 | Jones et al. . | |
| 4,766,976 | 8/1988 | Wallick, Jr. | 182/201 |
| 5,107,958 | 4/1992 | Johnson . | |

FOREIGN PATENT DOCUMENTS

| | | | |
|---|---|---|---|
| 1679046 | 2/1967 | Germany | 182/204 |
| 363510 | 12/1931 | United Kingdom | 182/205 |

*Primary Examiner*—Alvin C. Chin-Shue
*Attorney, Agent, or Firm*—Ian F. Burns

[57] ABSTRACT

A ladder leveling device is provided with an integrally formed tubular guide, a locking mechanism, a support shaft and a pivot foot. The tubular guide is attached to a ladder through its base portion. A guide bore is provided in the tubular guide for receiving the support shaft which may slide within the guide bore. A locking mechanism is housed in a lock portion of the tubular guide. The locking mechanism locks the support shaft in a fixed position relative to the tubular guide. The lock portion of the tubular guide protects the locking mechanism from foreign objects and reduces the risk of accidental release. A hole is provided on the side and rear surfaces of the lock portion for operating the locking mechanism and further increasing the safety and ease of use of the invention.

2 Claims, 2 Drawing Sheets

LADDER LEVELING DEVICE

BACKGROUND OF THE INVENTION

1. Field of Invention

This invention relates to a novel device for use with a ladder and more particularly to an improved device for leveling and stabilizing a ladder on an uneven surface.

2. Description of Possible Prior Art

Ladders must frequently be used at locations that do not provide a level surface. However, uneven surfaces substantially interfere with the safe and efficient operation of conventional ladders. What has long been needed is a ladder leveling device that provides safe, secure operation on slopping or uneven surfaces and yet may be produced at a low cost. Current designs are difficult to attach securely, difficult to adjust, are not rigid enough for safe use, are prohibitively expensive, are subject to accidental release and are not adaptable to different ladders.

The invention disclosed in U.S. Pat. No. 5,325,936 to Baker solves many of these problems. However, one of the weaknesses of this device is that the means for locking the support shaft are susceptible to accidental release. Tools, clothing and falling objects can brush against and catch the locking means thereby disengaging the locking means and freeing the support shaft.

When a ladder leveling device is secured to a ladder, the ladder's rung ends or rung welds can interfere with the placement and operation of the leveling device. In Baker, the leveling device uses jack screws to provide a horizontal clearance between the ladder and the support shaft. However, this design is more expensive to manufacture because jack screws are more expensive than other fastening means such as standard nuts and bolts. The jack screws also provide more surfaces upon which tools, clothes and debris may become snagged thereby creating a safety hazard and nuisance.

SUMMARY OF THE INVENTION

1. Brief Description of the Invention

The present invention provides a device to level and stabilize a ladder on an uneven surface. The major parts of the invention include a tubular guide, a support shaft, a locking mechanism and a pivot foot. The tubular guide includes a base portion for mounting the device on a ladder and a lock portion for housing the locking mechanism. The tubular guide may be formed by extrusion thereby greatly simplifying the manufacturing process, reducing its cost and increasing its strength.

The base portion of the tubular guide is attached to a ladder by threaded bolts and nuts. A plurality of holes are provided in the base portion for receiving the bolts. The base portion has a predetermined thickness that provides a horizontal separation between the ladder and the tubular support shaft. This separation prevents any ladder rang ends or rung welds from interfering with the support shaft.

The support shaft is located within the tubular guide and may be locked in position with the locking mechanism. A plurality of holes are provided on the support shaft for receiving a locking pin of the locking mechanism. However, when the locking mechanism is disengaged, the tubular support shaft is free to slide within the tubular guide and may be adjusted to different positions.

The locking mechanism comprises a trigger and a locking pin. When the locking pin is in a locked position, it is received by a hole on the support shaft. The trigger is located within the lock portion of the tubular guide and its position makes it highly resistant to inadvertent release. The trigger pivots on a fulcrum pin and is secured to the locking pin. A spring is provided for biasing the trigger to its locked position. When the trigger is depressed, the locking pin is disengaged from the hole of the support shaft and the shaft is free to slide within the tubular guide. When the trigger is released, the spring forces the trigger into its locked position and the locking pin will engage a hole of the support shaft thereby locking the position of the support shaft relative to the tubular guide.

The lock portion of the tubular guide includes a hole for accessing the rigger of the locking mechanism. The hole is open on the rear and side surfaces of the lock portion. This configuration reduces the possibility that the locking mechanism will be accidental released.

The pivot foot is pivotally attached to the support shaft. During normal operation, the pivot foot rests on the ground and supports the support shaft.

2. The Object of the Invention

It is a first object of the present invention to provide a ladder leveling device with an improved locking means which is less susceptible to accidental release.

It is a second object of the present invention to provide an inexpensive and safe means of securing the leveling device to a ladder.

It is a third object of the present invention to provide an improved design which is less expensive to manufacture.

It is a fourth object of the present invention to provide an improved design which provides greater strength than prior art devices.

It is a fifth object of the present invention to provide a horizontal separation between ladder rung ends and the support shaft of the leveling device.

These and other objects and advantages of the present invention may be realized by reference to the remaining portion of the specification and drawings.

DESCRIPTION OF THE PREFERRED EMBODIMENT

Figure 1:
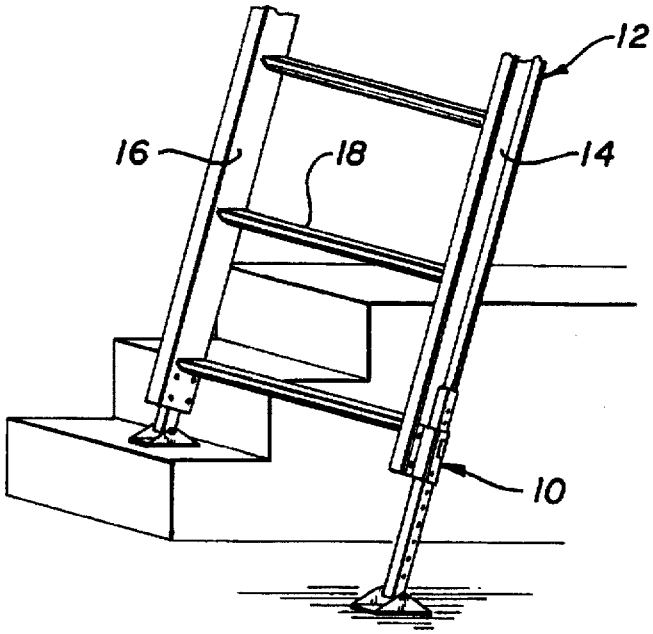
FIG. 1 is a simplified perspective view of one form of the leveling device in use with a ladder.

FIG. 1 shows a ladder leveling device 10 in use with a conventional ladder 12 having a right siderail 16 and a left siderail 14. Each siderail is connected to a plurality of rungs 18, thereby forming ladder 12.

Figure 2:
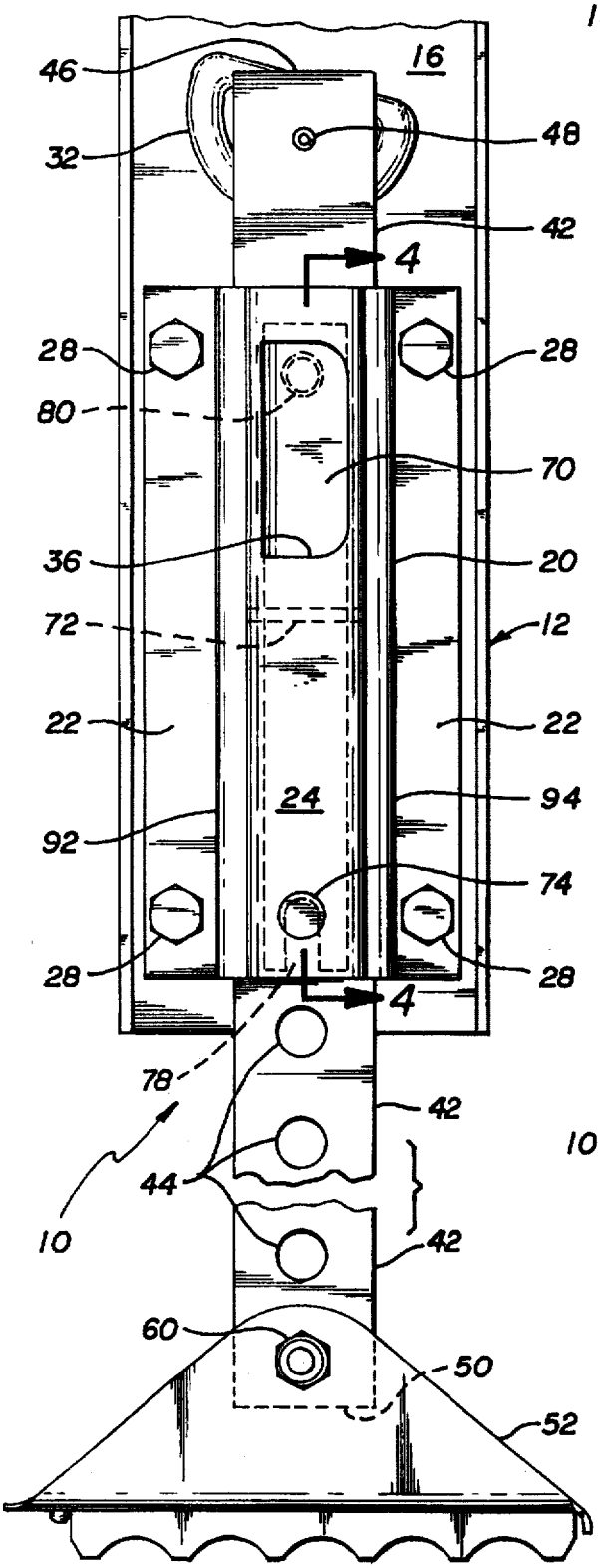
FIG. 2 is a side view of one form of the leveling device.
Figure 3:
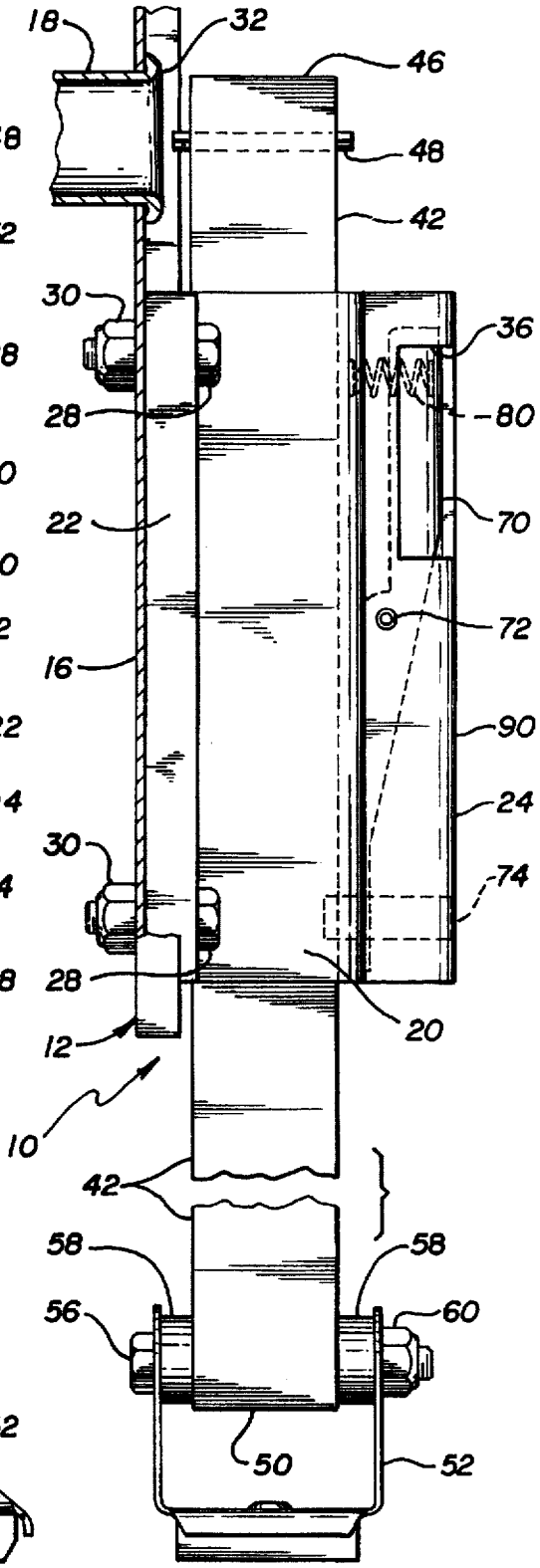
FIG. 3 is a frontal view of one form of the leveling device.

FIGS. 2 and 3 show ladder leveling device 10 of the present invention comprising a tubular guide 20 having a base portion 22 for securing to a ladder and a lock portion 24 for housing a locking mechanism. A tubular guide 20 with base portion 22 and lock portion 24 are formed from a single segment of extruded material. Methods of manufacturing material and parts through extrusion are well known in the art and may be used to fashion tubular guide 20.

Prior art devices often employ welds to attach various parts of the leveling device together. However, welded devices take more time to produce and require additional steps in the manufacturing process. Furthermore, welded joints are usually weaker than integrally formed parts and they are more susceptible to fatigue stress and corrosion. The present invention simplifies construction, reduces cost and increases strength by using a single extruded part to form tubular guide 20.

In the preferred embodiment of the present invention, tubular guide 20 is made of anodized aluminum. It has been found that anodized aluminum offers high strength, low weight and corrosion resistance in comparison with other materials. However, other materials may also be used in the present invention.

Base portion 22 of tubular guide 20 has a plurality of holes 26 for receiving bolts 28. Bolts 28 and lock nuts 30 are used to secure ladder leveling device 10 to siderail 16 of ladder 12. In the preferred embodiment, four holes 26 are provided on base portion 22. However, a greater or less number of holes may also be provided.

A problem encountered in prior art devices is providing clearance for rung ends 32. Ladders often have rungs 18 which protrude past ladder siderails 16. This creates an obstacle for ladder levelers because ladder levelers must somehow be fastened securely to ladder siderails and support shafts must not be hindered by any protruding rung ends. In the present invention this problem is overcome by providing a base portion 22 that has a short longitudinal length and a predetermined horizontal thickness. The short longitudinal length allows ladder leveler 10 to be placed above or below any protruding rung end 32 so that it can be securely bolted to ladder siderail 16. The horizontal thickness of base portion 22 provides a clearance between rung end 32 and a support shaft 42 so that there is no interference. It has been determined that a ⅜ inch horizontal thickness is sufficient for all commonly used ladders.

A tubular guide 20 is provided with a guide bore 40 for receiving support shaft 42. In the preferred embodiment of the present invention, guide bore 40 and support shaft 42 have a square cross section, however, other cross sections, such as polygon or round, may also be used. In the preferred embodiment, support shaft 42 is also made by extrusion and is composed of anodized aluminium. Support shaft 42 is slidable within guide bore 40. A plurality of longitudinally aligned holes 44 are provided on one longitudinal side of support shaft 42. Support shaft 42 also has a restraint pin 48 at upper end 46 for preventing support shaft 42 from sliding out of tubular guide 20.

At lower end 50 of support shaft 42, a pivoting foot 52 is secured to support shaft 42 by a bolt 56 and a lock nut 60. Spacers 58 are provided to maintain pivoting foot 52 in its correct position relative to support shaft 42.

Figure 4:
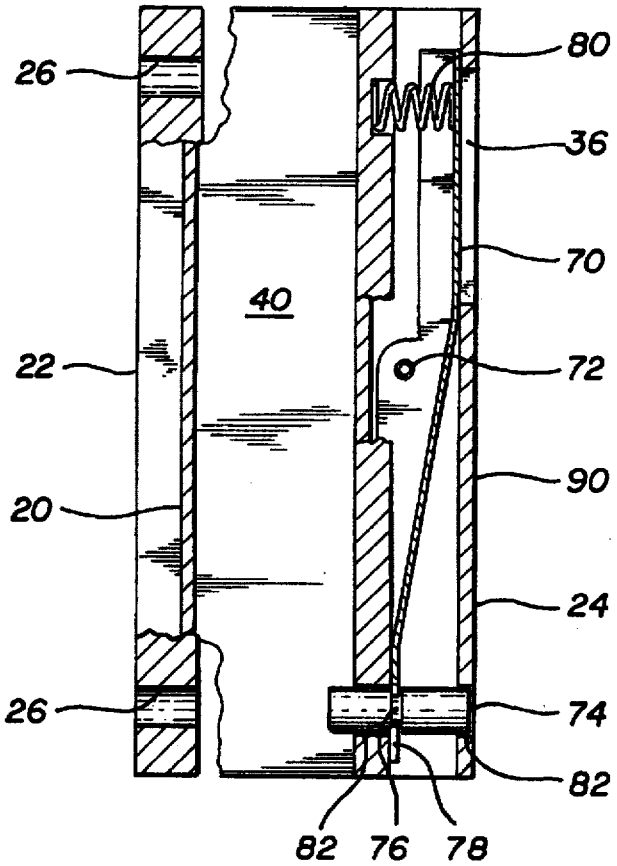
FIG. 4 is a right side cross sectional view of the tubular guide and locking mechanism of the leveling device along line 4—4 as shown in FIG. 2.

As seen in FIG. 4, support shaft 42 is locked in position relative to tubular guide 20 by a locking mechanism housed in lock portion 24 of tubular guide 20. The locking mechanism comprises a trigger 70, a fulcrum pin 72, a locking pin 74 and a spring 80. In its locked position, locking pin 74 penetrates guide holes 82 and engages one of holes 44 of support shaft 42. A gap 78 is provided on trigger 70 for an engaging groove 76 on locking pin 74. When trigger 70 is depressed, trigger 70 pivots on fulcrum pin 72 and forces pin 74 to move horizontally, thereby disengaging support shaft 42. When trigger 70 is released, spring 80 forces trigger 70 and pin 74 to return to their locked positions. In the preferred embodiment of the present invention, trigger 70, fulcrum pin 72, locking pin 74 and spring 80 are all made of stainless steel.

Lock portion 22 of tubular guide 20 is provided with a trigger hole 36 for allowing the user of the invention to press trigger 70. Because trigger 70 is housed within lock portion 24 and is recessed below the outer surface of lock portion 24, the locking mechanism is less likely to be accidentally released. Unlike some prior art devices, it is unlikely that falling objects or the user's tools and clothes will inadvertently release the locking mechanism.

Lock portion 24 has a side surface 90, a rear surface 92 and a front surface 94. When the ladder is in normal operation, the side facing the user as he climbs the ladder is front surface 94, the side facing away from the user is rear surface 92 and the side facing 90 degrees from the user is side surface 90. Lock potion 24 has trigger hole 36 for allowing access to trigger 70. Trigger hole 36 is located on rear surface 92 and side surface 90 but not on front surface 94. It has been found that this design increases the safety of the invention. The user and his clothes and tools are less likely to touch trigger 70 when the user ascends or descends the ladder. Furthermore, falling objects are less likely to impact against trigger 70 because rear surface 92 is negatively sloped when the ladder is in normal operation. Falling objects are most likely to strike front surface 94.

In addition to improving safety, it has been found that the location of trigger hole 36 also improves the operation of the invention. In normal operation, the user places his palm on the inside of siderail 16, wraps his fingers around the rear surface of siderail 16 and places his finger tips on trigger 70. He may then squeeze trigger 70 using siderail 16 as an opposing structure; similar to the way a trigger is pulled on a gun. This has been found to be much easier and more comfortable than pushing the trigger against an opposing structure. In normal operation, the user also has a free hand available to adjust the height of support shaft 42.

It will be apparent that various modifications can be made in the particular ladder leveler device described above and shown in the drawings within the scope of the present invention. The size, configuration and arrangement of components can be different to meet specific requirements. Therefore, the scope of the present invention is to be limited only by the following claims:

What is claimed is:

1. A ladder leveling device for supporting a ladder in a substantially vertical position on an uneven surface comprising:

(a) an extruded tubular guide having an integrally formed base portion, lock portion and guide bore, (b) securing means associated with said base portion for securing said tubular guide to a ladder, (c) a support shaft for adjustably supporting said ladder when said ladder leveling device is attached to said ladder, said support shaft being slidably secured in said guide bore, (d) a locking mechanism housed within said lock portion for locking said support shaft in a fixed position relative to said tubular guide whereby said fixed position is selected from a plurality of possible positions, and (e) a pivot foot, pivotally attached to said support shaft for supporting said ladder on a working surface, wherein said lock portion comprises a housing defining an inner chamber, said locking mechanism being located in said inner chamber and shielded from foreign objects whereby said locking mechanism is resistant to accidental release, wherein said locking mechanism comprises a trigger for operating said locking mechanism, said housing of said lock portion comprises a front wall, a rear wall, a side wall, and a trigger hole for providing access to said trigger, said trigger hole being located only in said rear and side walls, whereby said trigger is shielded from foreign objects, said locking mechanism is further resistant to accidental release, and said trigger is easily operated by a person.

2. A ladder leveling device for supporting a ladder in a substantially vertical position on an uneven surface comprising:

(a) an extruded tubular guide having a base portion, lock portion and guide bore, said lock portion comprising a housing defining an inner chamber, (b) securing means associated with said base portion for securing said tubular guide to a ladder, (c) a support shaft for supporting said ladder when said ladder leveling device is attached to said ladder, said support shaft being slidably received in said guide bore, (d) a locking mechanism for locking said support shaft in a fixed position relative to said tubular guide, said locking mechanism being located substantially within said inner chamber whereby said fixed position is selected from a plurality of possible positions to level said ladder and said locking mechanism is protected by said housing and resistant to accidental release, and (e) a pivot foot, pivotally attached to said support shaft for supporting said ladder on a working surface, wherein said locking mechanism comprises a trigger for operating said locking mechanism, said housing of said lock portion comprises a front wall, a rear wall, a side wall, and a trigger hole for providing access to said trigger, said trigger hole being located on said rear and side walls, whereby said trigger is easily operated by a person.

* * * * *